United States Patent [19]

Retzlaff

[11] 4,071,154

[45] Jan. 31, 1978

[54] BRACKET CONNECTION FOR BACKHOE AND SKIP LOADER

[76] Inventor: Reynold R. Retzlaff, 552 Bean Creek Road No. 24, Scotts Valley, Calif. 95066

[21] Appl. No.: 720,260

[22] Filed: Sept. 3, 1976

[51] Int. Cl.[2] ..... E02F 3/70

[52] U.S. Cl. ..... 214/145 A; 172/272

[58] Field of Search ..... 214/138 R, 145 R, 145 A; 172/272, 273; 24/243 FM

[56] References Cited

U.S. PATENT DOCUMENTS

| | | | |
|---|---|---|---|
| 2,963,183 | 12/1960 | Przybylski | 214/145 A |
| 3,233,350 | 2/1966 | Malzahn et al. | 172/273 |
| 3,237,795 | 3/1966 | Kromer | 214/145 A X |
| 3,417,886 | 12/1968 | Stuart | 214/145 A |
| 3,672,521 | 6/1972 | Bauer et al. | 214/145 A |
| 3,794,195 | 2/1974 | Clevenger et al. | 214/145 A |

*Primary Examiner*—L. J. Paperner
*Attorney, Agent, or Firm*—Jack M. Wiseman

[57] ABSTRACT

A quick-connector mechanism for attaching a material handling implement, such as a bucket or a blade, to the control arms of a backhoe or the like. The mechanism includes a socket, formed by spaced bars at the rear of the implement, which receives a plate that is provided on a hitch pivotally mounted on the control arms. A transverse pin locks the implement to the hitch when the plate is engaged in the socket.

7 Claims, 5 Drawing Figures

BRACKET CONNECTION FOR BACKHOE AND SKIP LOADER

BACKGROUND OF THE INVENTION

This invention relates to equipment such as backhoes, end loaders and the like, and more particularly to a mechanism for quickly attaching a material handling implement to such equipment.

Many material handling vehicles of the type in which a bucket is mounted at the end of a lift or control arm can be used with different size buckets and with other implements which are interchangeable with the bucket. Several types of coupling mechanisms have been provided for this type of use but, due to the fact that the coupling mechanism must resist considerable stresses during operation, they often employ interengaging parts which are heavy in construction and difficult to assemble and disassemble. Also, after a period of use, dirt and mud often encase the connecting parts, making them difficult to engage with wrenches and other tools. Thus, more time and labor are spent in disconnecting one implement and fixing another one in its place.

Mechanisms that have been proposed for coupling implements to loaders and the like include the coupler disclosed in the U.S. patent to Kramer No. 3,237,795 wherein latch plates are spring-urged into position and withdrawn by a cable extending to the operator's position. U.S. Pat. No. 3,794,195 discloses the use of hooks to hold an implement in place on a loader, while U.S. Pat. No. 3,760,883 provides link-actuated pins for locking an implement on a tractor frame. U.S. Pat. No. 3,417,886 discloses a triangular socket located at the center of a bucket and pinreceiving holes in laterally-spaced wings formed on the bucket. The above-mentioned patents concern mechanisms which are typical of those now available, and are in sharp contrast to the mechanism of the present invention which is simple and sturdy in construction and permits quick, effective connecting and disconnecting of the implements to the vehicle.

SUMMARY OF THE INVENTION

The present invention concerns a coupling mechanism for attaching an implement to the control arms of a vehicle such as a backhoe, said coupling including a first coupling member in the form of a pair of spaced bars that extend across the rear portion of the implement to define a socket and a second coupling member which will be referred to hereinafter as a hitch and is carried by the control arms of the vehicle. The hitch is provided with a transverse plate and, when the plate is disposed in the socket, one of the bars of the socket rests on a transverse bar on the hitch in position to transfer the weight of a load on the implement directly to the control arms of the vehicle with a minimum amount of the load being carried by a pin which secures the implement to the hitch.

Further, the bars of the socket interengage with the opposed walls of the hitch plate so that pushing and pulling stresses are transmitted through these parts which extend a major distance across the bucket for distribution of the stresses.

Accordingly, it is an object of the present invention to provide a material handling implement having bar and plate interengaging members that extend a substantial distance across the bucket to distribute stresses in a generally uniform manner.

Another object is to provide a coupling that can be quickly and easily assembled in a minimum of time and with a minimum of labor.

DESCRIPTION OF THE PREFERRED EMBODIMENT

Figure 1:
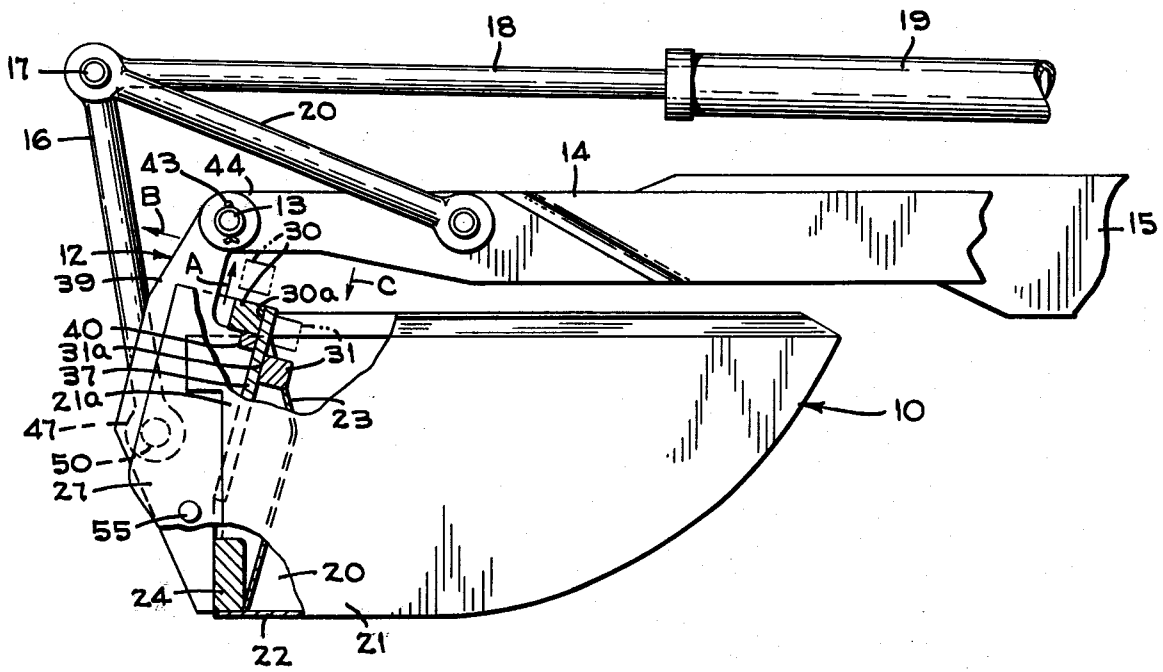
FIG. 1 is a side elevation, with parts broken away, particularly showing a bucket connected to a hitch, carried on the control arms of a backhoe by the coupling of the present invention.

Referring to FIG. 1, a bucket 10 is removably attached to a hitch 12 which is pivotally connected by pin 13 to a lower control arm in the form of a boom 14 of a backhoe 15, and to an actuating rod 16 which is pivotally connected in a conventional manner by pin 17 to an upper control arm in the form of the rod 18 of a power cylinder 19 of the hoe. A second actuating rod 20 is pivotally connected to the boom and to the pin 17.

Figure 2:
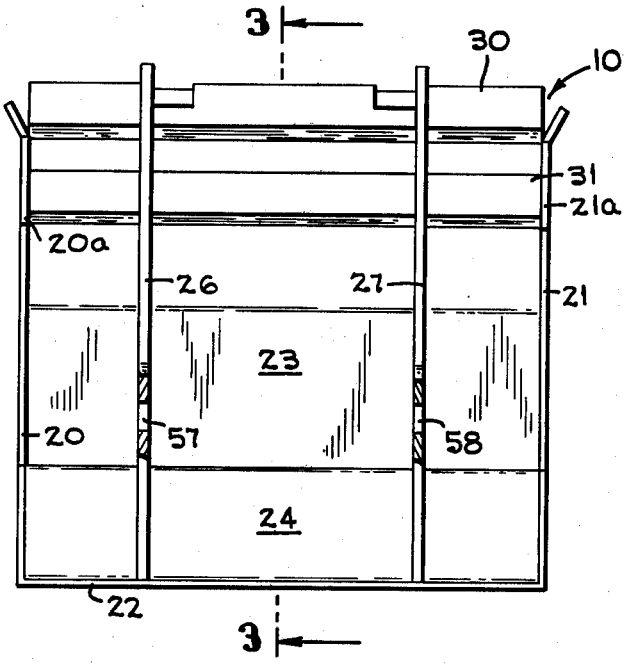
FIG. 2 is an end elevation of the bucket of FIG. 1.
Figure 3:
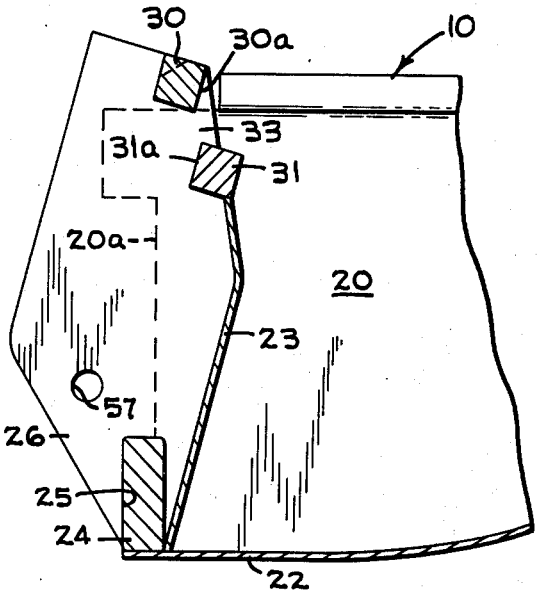
FIG. 3 is a section taken along line 3—3 of FIG. 2.

The bucket is particularly shown in FIGS. 2 and 3 and comprises two spaced side walls 20 and 21, a floor 22, and a back wall 23. The side walls are connected near their lower rearward edges by a relatively heavy transverse beam 24 which may be welded or otherwise secured to the side walls and to the floor of the bucket. A pair of upright mounting plates 26 and 27 extend rearwardly from the back wall of the bucket, being welded to said back wall and to the transverse beam 24 which is received in a notch 25 cut in the lower end of each mounting plate. The mounting plates are connected near their upper edges by a pair of transverse bars 30 and 31, bar 31 also extending to and being secured to the bucket side walls 20 and 21 which have portions 20*a* and 21*a* extending past the rear wall of the bucket as seen in FIG. 3.

It will be noted that the bars 30 and 31 are of square crosssection and have spaced, parallel faces 30*a* and 31*a* defining an opening 33.

Figure 4:
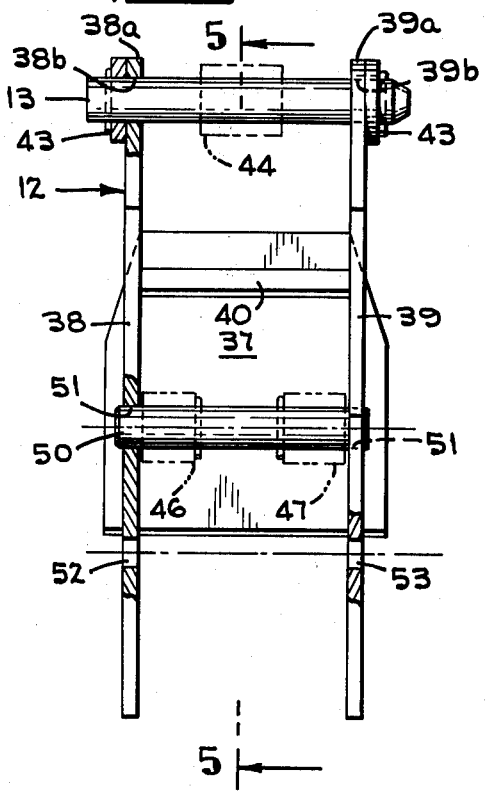
FIG. 4 is an end elevation of the hitch of FIG. 1, with pivot pins in place and with parts broken away and parts of the backhoe shown in phantom lines.
Figure 5:
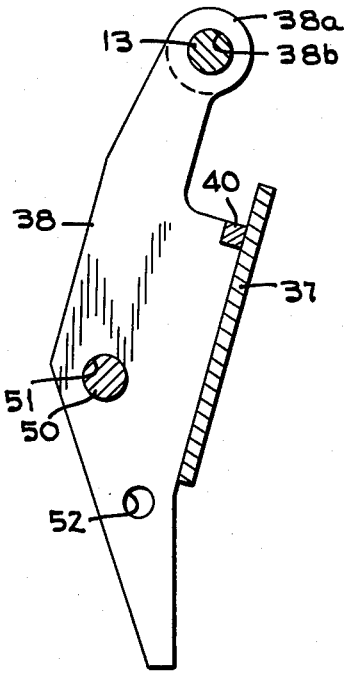
FIG. 5 is a section taken along line 5—5 of FIG. 4.

The hitch is shown in FIGS. 4 and 5 and comprises a transverse plate 37 from which two rearwardly extending parallel arms 38 and 39 extend at right angles. A bar 40 (FIG. 5) is welded between the arms 38 and 39 and is in abutting relation with the transverse plate 37 to which it is also secured. The arms 38 and 39 have reinforced upper ends 38*a* and 39*a* providing aligned holes 38*b* and 39*b* which receive the pivot pin 13 therethrough. As shown in phantom lines in FIG. 4, a sleeve portion 44 formed at the outer end of the boom 14 is pivotally disposed on the pin 13. Cotter pins 43 at the ends of the pivot pin 13 retain the pin in place. Also shown in phantom lines in FIG. 4 are two spaced sleeve-like end portions 46 and 47 of a yoke to which the control rod 16 (FIG. 1) is connected as by a threaded joint. A pivot pin 50 which fits in openings 51 in the upright hitch arms 38 and 39 receives the yoke end portions to pivotally mount the lower end of the hitch on the control rod 16.

The hitch mounting arms are also provided with aligned holes 52 and 53 which are adapted to receive a pivot pin 55 (FIG. 1) which also extends through aligned openings 57 and 58 (FIG. 2) in the mounting plates 26 and 27 of the buckets. As seen in FIG. 1, the hitch arms 38 and 39 are disposed inwardly of the mounting plates 26 and 27 of the bucket when the bucket is connected to the hitch. Cotter pins retain the pivot pin 55 in place.

Referring to FIG. 1, when the bucket is locked on the hitch 12, the upper end portion of the transverse plate 37 is disposed between the transverse bars 30 and 31, with one face of the plate abutting the face 30*a* of bar 30 and the other face of the plate abutting face 31*a* of bar 31. Also, it should be noted that the lower forward edges of the arms 38 and 39 of the hitch are in abutting engagement with the heavy beam 24 of the bucket. Thus, the force of the hitch 12 in pushing or pulling the bucket is across the entire width of the bucket and, further, the pivot pin 55 is not relied on to absorb these forces. Similarly, when the bucket is in position, the upper bar 30 of the bucket rests on the bar 40 of the hitch and, as a result, downward forces on the bar 30 due to loads in the bucket are transmitted directly to the hitch through the hitch bar 40. Further, loads in the bucket which tend to pivot the bucket clockwise (FIG. 1) are resisted by the contact of the bars 30 and 31 and the beam 24 with the hitch plate 37 over a considerable area.

It will be evident that, when the bucket is to be removed from the hitch, it can be moved by the boom and the control arm 16 to the position of FIG. 1 and pin 55 can be quickly driven out. Then, if relative movement is effected between the bucket and the hitch so that the bucket is moved relative to the hitch in the direction of arrow A until the bars 30 and 31 of the bucket reach the position shown in phantom lines. At this position, the bar 30 is clear of the plate 37 and the hitch 12 can be moved in the direction indicated by arrow B to separate the members.

The bucket is quickly and easily reinstalled by maneuvering the hitch and the bucket to a position wherein the bars 30 and 31 are in the phantom line position of FIG. 1 relative to the hitch plate 37. Then the plate 37 can be moved upwardly in the direction of arrow A or the bucket can be lowered in the direction of arrow C to move the members into operative engagement. Then the retaining pin 55 can be driven into place. It will be understood that any other bucket or other material handling implement, such as a blade, can be attached to the hitch plate in the same manner as long as it is provided with the bars 30 and 31 and the equivalent of the mounting plates 26 and 27 which receive the retaining pin 55.

From the foregoing, it will be seen that the present invention provides a quick-coupling mechanism that is extremely simple in construction and yet is arranged to effectively absorb the stresses and strains of operation.

I claim:

1. In a coupling mechanism for attaching an implement to the control arms of a backhoe or the like wherein a first coupling member is mounted on the control arms for engagement with a second coupling member carried by the implement, the improvement which comprises transversely extending spaced parallel bars carried by said second coupling member to define a socket and providing abutment means extending transversely across substantially the entire width of said implement, a transverse plate carried by said first coupling member and having an upper end portion adapted to be inserted into said socket with its transverse faces engaging said bars in an abutting relation, transverse means on said first coupling member adapted for movement into contact with said abutment means as said plate is moved into said socket, and locking means for holding said coupling members together when said plate is disposed in said socket.

2. A mechanism according to claim 1 wherein said locking means includes holes on said first and second coupling members movable into alignment when said plate is moved into said socket, and pin means adapted to be inserted in aligned holes to prevent movement of said coupling members in a direction normal to said pin means.

3. In a coupling mechanism for attaching an implement to the control arms of a backhoe or the like wherein a first coupling member is mounted on the control arms for engagement with a second coupling member carried by the implement, the improvement which comprises spaced bars carried by said second coupling member to define a socket and providing abutment means extending transversely across substantially the entire width of said implement. a plate carried by said first coupling member and having an upper end portion adapted to be inserted into said socket, transverse means on said first coupling member adapted for movement into contact with said abutment means as said plate is moved into said socket, and locking means for holding said coupling members together when said plate is disposed in said socket, said transverse means including a bar extending across the first coupling member and an abutment surface on said plate, said last-mentioned bar and surface being movable into stress-transmitting engagement with the spaced bars of said second coupling member.

4. In a coupling mechanism for attaching an implement to the control arms of a backhoe or the like wherein a first coupling member is mounted on the control arms for engagement with a second coupling member carried by the implement, the improvement which comprises spaced bars carried by said second coupling member to define a socket and providing abutment means extending transversely across substantially the entire width of said implement, a plate carried by said first coupling member and having an upper end portion adapted to be inserted into said socket, transverse means on said first coupling member adapted for movement into contact with said abutment means as said plate is moved into said socket, and locking means for holding said coupling members together when said plate is disposed in said socket, on of said bars of said second coupling member being disposed forwardly in the implement relative to the other bar and being at a lower elevation than said other bar, and wherein said transverse means of said first coupling member includes an abutment surface on the forward face of said plate movable into engagement with said lowest bar on said implement and further includes a hitch bar disposed closely adjacent the rear face of said plate for movement into contact with the uppermost bar on the implement.

5. In a coupling mechanism for attaching a bucket to the control arms of a backhoe or the like in which a first coupling member is mounted on the control arms for engagement with a second coupling member carried by the implement, the improvement wherein said second coupling comprises rearward extensions on the side walls of the bucket, a beam extending between said extensions rearwardly of the back wall of the bucket, a pair of bars extending between said side walls in spaced relation to define a socket on said bucket near the upper rearward end thereof, and wherein said first coupling member comprises a hitch including a pair of upright arms pivoted on a common axis from the control arms of the hoe, a plate secured to the leading edges of said arms to extend in a plane parallel to the pivot axis of said arms, and a bar secured between said arms closely adjacent the rear face of said plate, the bar on said hitch being movable into abutting contact with one of the bars on said bucket when said plate is moved into said socket, and the leading edges of the arms of said hitch being movable into engagement with said beam incident to the movement of said plate into said socket.

6. A coupling mechanism according to claim 5 further including means defining holes on said arms and on the rearward extensions of said bucket side walls, a hole on each of said arms being movable into alignment with a hole on one of said side wall extensions incident to movement of said plate into said socket, and means insertable into each pair of aligned holes for locking said first coupling member to said second coupling member.

7. In a coupling mechanism for attaching an implement to the control arms of a backhoe or the like wherein a first coupling member is mounted on the control arms for engagement with a second coupling member carried by the implement, the improvement which comprises transversely extending parallel members defining a socket on said second coupling member, a transverse plate carried by said first coupling member with its transverse faces engaging said members in abutting relation to link said coupling members together at a first juncture area, and a pin connecting said coupling members together at an area spaced from said first area, said transverse faces of said plate having pressure-transmitting contact with said socket-defining members for transmitting pressure to the implement in directions generally longitudinally of the implement, one of said socket-defining members being in contact with a portion of said first coupling member to transmit downward pressure to said first coupling member throughout a major portion of the width of the implement.

* * * * *